US007231779B2

(12) United States Patent
Koo

(10) Patent No.: US 7,231,779 B2
(45) Date of Patent: Jun. 19, 2007

(54) FAN ASSEMBLY FOR REFRIGERATOR

(75) Inventor: Min-Bon Koo, Changwon (KR)

(73) Assignee: LG Electronics Inc., Seoul (KR)

( * ) Notice: Subject to any disclaimer, the term of this patent is extended or adjusted under 35 U.S.C. 154(b) by 405 days.

(21) Appl. No.: 10/824,365

(22) Filed: Apr. 15, 2004

(65) Prior Publication Data

US 2004/0206107 A1 Oct. 21, 2004

(30) Foreign Application Priority Data

Apr. 16, 2003 (KR) ..... 10-2003-0024029
Apr. 22, 2003 (KR) ..... 10-2003-0025556

(51) Int. Cl.
*F25D 25/00* (2006.01)

(52) U.S. Cl. ..... 62/407; 62/465

(58) Field of Classification Search ..... 62/298, 62/407, 465; 165/104.18; 454/201
See application file for complete search history.

(56) References Cited

U.S. PATENT DOCUMENTS 3,759,321 A * 9/1973 Ares ..... 165/125
4,202,409 A * 5/1980 Cann et al. ..... 165/122
5,461,880 A * 10/1995 Bolton et al. ..... 62/298
5,511,939 A * 4/1996 Tokunaga et al. ..... 415/206

* cited by examiner

*Primary Examiner*—Melvin Jones
(74) *Attorney, Agent, or Firm*—Birch, Stewart, Kolasch & Birch, LLP

(57) ABSTRACT

The present invention relates to a fan assembly for a refrigerator. The fan assembly of the present invention is used in a refrigerator which includes a refrigerating chamber formed at a relatively lower portion of a main body of the refrigerator, a freezing chamber formed at a relatively upper portion of the main body and a heat exchange chamber partitioned behind at least the freezing chamber for producing cold air. The fan assembly comprises a fan motor, a blow fan driven by the fan motor for producing a cold air flow supplied to the refrigerating and freezing chambers, a fan guide through which the cold air flow passes and on which the fan motor and the blow fan are installed, at least two mounting leg which are formed on one side of the fan guide and coupled to a rear wall of the heat exchange chamber with fastening screws, a fixing hook which is formed on the fan guide at a side opposite to the mounting leg and hooked into a ceiling of the heat exchange chamber, and at least one wire hanger which is provided on the fan guide and on which a lead wire through which electrical signals for driving the fan motor are transferred is hung and supported. According to the present invention, there are advantages in that the fan assembly can be easily mounted or detached, its mounting state can be firmly maintained, and the damage of the lead wire can be prevented.

17 Claims, 7 Drawing Sheets

FAN ASSEMBLY FOR REFRIGERATOR

This Nonprovisional application claims priority under 35 U.S.C. § 119(a) on patent application Ser. No. 10-2003-0024029 and 10-2003-0025556 filed in KOREA on Apr. 16, 2003 and Apr. 22, 2003, the entire contents of which are hereby incorporated by reference.

BACKGROUND OF THE INVENTION

1. Field of the Invention

The present invention relates to a refrigerator, and more particularly, to a fan assembly for transferring cold air produced in a heat exchange chamber to a storage space in a refrigerator.

2. Description of the Prior Art

FIG. 1 shows main components of a general refrigerator. As shown in this figure, a refrigerating chamber 52, a vegetable box 53 and a freezing chamber 54 are defined sequentially from above in a main body 51 of the refrigerator. On a rear wall of the main body 51 of the refrigerator is formed a projection wall 55 protruding forwardly at a middle height of the vegetable box 53. A heat exchange chamber 56 in which cold air is produced is formed below the projection wall 55, while a cold air passage through which the cold air is supplied into the refrigerating chamber 52 is formed above the projection wall 55. To allow the cold air passage 57 and the heat exchange chamber 56 to communicate with each other, a communication hole 55*a* is formed vertically through the projection wall 55.

An evaporator 58 for producing cold air and a fan assembly 59 for transferring the produced cold air to the vegetable box 53 or the refrigerating chamber 52 are installed within the heat exchange chamber 56. For the installation and maintenance of parts in the heat exchange chamber 56, the components required in partitioning the vegetable box 53 and the freezing chamber 54 is divided into two parts, i.e. a first partition wall (not shown) and a second partition wall 60. In a state where the second partition wall 60 is removed, the installation or maintenance works for the evaporator 58 or the fan assembly 59 are made. The second partition wall 60 is connected to the projection wall 55.

Above the projection wall 55 is provided a damper assembly 61 which defines one side of the cold air passage 57 and includes a damper 61*a* for regulating cold air flow through the cold air passage 57. A duct-forming member 62 is provided above the damper assembly 61 to define the cold air passage 57 on a side of the refrigerating chamber 52.

In the meantime, FIG. 2 shows the configuration of the fan assembly 59. The fan assembly 59 is configured in such a manner that a fan motor 59*m* is installed on a fan guide 59*g* and a blow fan 59*f* is provided at an output shaft of the fan motor 59*m*. The fan guide 59*g* is formed with fastening holes 59*h* at opposite ends thereof such that it can be fastened to an inner side of the main body 50 of the refrigerator.

However, the related art fan assembly has the following problems.

The installation or maintenance works for the related art fan assembly 59 are very troublesome, because there is no additional configuration for temporarily fixing the fan assembly 59. That is, an operator should couple fasteners into the fastening holes 59*h* with a tool held by one hand while securing the fan assembly at the inner wall of the refrigerating chamber 54 of the refrigerator body 51 with another hand. In particular, since the fastening holes 59*h* are provided at the opposite ends of the fan guide 59*g* of the fan assembly 59, an available space cannot be obtained between the adjacent parts. Thus, coupling or decoupling of the fan assembly through the fasteners becomes more difficult.

Further, one side of the fan assembly 59 where the fastening holes 59*h* are located is fixed to the main body 51 of the refrigerator, whereas the other side thereof is not supported as if it behaves as a free end of a cantilever. Therefore, the other side of the fan assembly 59 where the fastening holes 59*h* are not located may be lowered due to its own weight. Accordingly, there is a problem in that air streams are not correctly produced by the fan assembly 59 and thus air leakage can occur.

Furthermore, according to the prior art, one end of a lead wire (not shown) for applying electric power to the fan assembly 59 is connected to the fan assembly 59, and the other end thereof is connected to a control unit while passing through an insulating layer of the main body 51 of the refrigerator. However, since additional components for fixing or hanging the lead wire is not provided in the heat exchange chamber 56, a portion of the lead wire sags under its own weight and accordingly may come into contact with the evaporator 58.

In such a case, since cooling fins of the evaporator 58 generally takes the shape of a plate made of a metallic material, edges of the fins are relatively sharp. Therefore, if the lead wire comes into contact with the cooling fins of the evaporator 58, an electric leakage may occur due to the damage of insulating coating of the lead wire. Further, since a temperature of the lead wire is lowered by the evaporator 58, there is another problem in that a withstanding voltage of the lead wire may be reduced.

SUMMARY OF THE INVENTION

The present invention is conceived to solve the aforementioned problems in the prior art. Accordingly, an object of the present invention is to provide a fan assembly for a refrigerator of which installation works can be easily made.

Another object of the present invention is to provide a fan assembly for a refrigerator, which can be firmly and correctly installed.

A further object of the present invention is to provide a fan assembly for a refrigerator, which can prevent a lead wire from being damaged.

According to an aspect of the present invention for achieving the objects, there is provided a fan assembly for a refrigerator, comprising a fan motor; a blow fan driven by the fan motor for producing a cold air flow in a direction opposite to a gravitational direction; a fan guide which horizontally partitions a heat exchange chamber, on which the fan motor and the blow fan are installed, and through which the cold air flow passes; a mounting leg which is formed on one side of the fan guide and coupled to a rear wall of the heat exchange chamber with a fastening screw; and a fixing hook which is formed on the fan guide at a side opposite to the mounting leg and hooked into a ceiling of the heat exchange chamber.

Preferably, the fan guide includes a horizontal base in which a through-hole is perforated and through which the air flow passes, and a pair of vertical walls which protrude from both ends of the horizontal base and are provided with the fixing hook on an upper end thereof, respectively.

Further, a plurality of link legs may be formed around portions of the horizontal base adjoining the through-hole, and a motor support with the motor seated thereon may be provided on tip ends of the link legs.

Preferably, one of the link legs positioned at a side opposite to a mounting direction of the mounting leg is further provided with a fastening rib coupled to a grille pan for partitioning the heat exchange chamber.

Preferably, the mounting leg is provided with shield walls extending in a longitudinal direction at both ends thereof.

More preferably, the fan guide is integrally formed with at least one wire hanger onto which a lead wire is hung.

Furthermore, the wire hanger may include a hanger portion of which one end is connected to the fan guide and into which the lead wire is securely positioned, and a guide portion which guides the lead wire into the hanger portion and is further spaced apart from a surface of the fan guide as it goes toward the tip.

According to another aspect of the present invention, there is provided a fan assembly for a refrigerator including a refrigerating chamber formed at a relatively lower portion of a main body of the refrigerator, a freezing chamber formed at a relatively upper portion of the main body and a heat exchange chamber partitioned behind at least the freezing chamber for producing cold air. The fan assembly comprises a fan motor; a blow fan driven by the fan motor for producing a cold air flow supplied to the refrigerating and freezing chambers; a fan guide through which the cold air flow passes and on which the fan motor and the blow fan are installed; at least two mounting leg which are formed on one side of the fan guide and coupled to a rear wall of the heat exchange chamber with fastening screws; a fixing hook which is formed on the fan guide at a side opposite to the mounting leg and hooked into a ceiling of the heat exchange chamber; and at least one wire hanger provided on the fan guide for hanging and supporting a lead wire through which electrical signals for driving the fan motor are transferred.

Preferably, the fan guide includes a horizontal base in which a through-hole is formed and on which the mounting legs and the wire hanger are formed, and a pair of vertical walls which protrude from both ends of the horizontal base in a direction opposite to the mounting legs and are provided with the fixing hook on an upper end thereof, respectively.

Further, a plurality of link legs may be formed around portions of the horizontal base adjoining the through-hole, and a motor support on which the motor is seated may be provided on tip ends of the link legs.

Preferably, one of the link legs positioned at a side opposite to a mounting direction of the mounting leg is further provided with a fastening rib coupled to a grille pan for partitioning the heat exchange chamber.

More preferably, the wire hanger includes a hanger portion of which one end is connected to the fan guide and into which the lead wire is securely positioned, and a guide portion which guides the lead wire into the hanger portion and is further spaced apart from a surface of the fan guide as it goes toward the tip.

According to a further aspect of the present invention, there is provided a fan assembly for a refrigerator, comprising a fan motor; a blow fan driven by the fan motor for producing a cold air flow which is supplied to the refrigerating and freezing chambers formed in a main body of the refrigerator; a fan guide through which the cold air flow passes and on which the fan motor and the blow fan are installed; and at least one wire hanger provided on the fan guide for hanging and supporting a lead wire through which electrical signals for driving the fan motor are transferred.

Preferably, the fan guide includes a horizontal base which is horizontally formed in a heat exchange chamber and is formed with at least two mounting legs coupled to the heat exchange chamber at one side thereof, and through which the air flow passes; and a pair of vertical walls which protrude from both ends of the horizontal base in a direction opposite to the mounting legs and, wherein a fixing hook hung into a ceiling of the heat exchange chamber is formed on a tip end of the vertical wall at a side of the horizontal base opposite to where the mounting legs are provided.

Preferably, the horizontal base is formed with a through-hole through which the cold air flow passes, a plurality of link legs are formed around portions of the horizontal base adjoining the through-hole, and a motor support on which the motor is seated is provided on tip ends of the link legs.

Preferably, one of the link legs positioned at a side opposite to a mounting direction of the mounting leg is further provided with a fastening rib coupled to a grille pan for partitioning the heat exchange chamber.

More preferably, the wire hanger includes a hanger portion of which one end is connected to the fan guide and into which the lead wire is securely positioned; and a guide portion which guides the lead wire into the hanger portion and is further spaced apart from a surface of the fan guide as it goes toward the tip.

The fan assembly for the refrigerator according to the present invention so configured has advantages in that the fan assembly can be easily mounted or detached, its mounting state can be firmly maintained, and the damage of the lead wire can be prevented.

BRIEF DESCRIPTION OF THE DRAWINGS

The above and other objects, features and advantages of the present invention will become apparent from the following description of preferred embodiments given in conjunction with the accompanying drawings, in which.

DESCRIPTION OF THE PREFERRED EMBODIMENTS

Hereinafter, a preferred embodiment of a fan assembly for a refrigerator according to the present invention will be described in detail with reference to the accompanying drawings.

Figure 1:
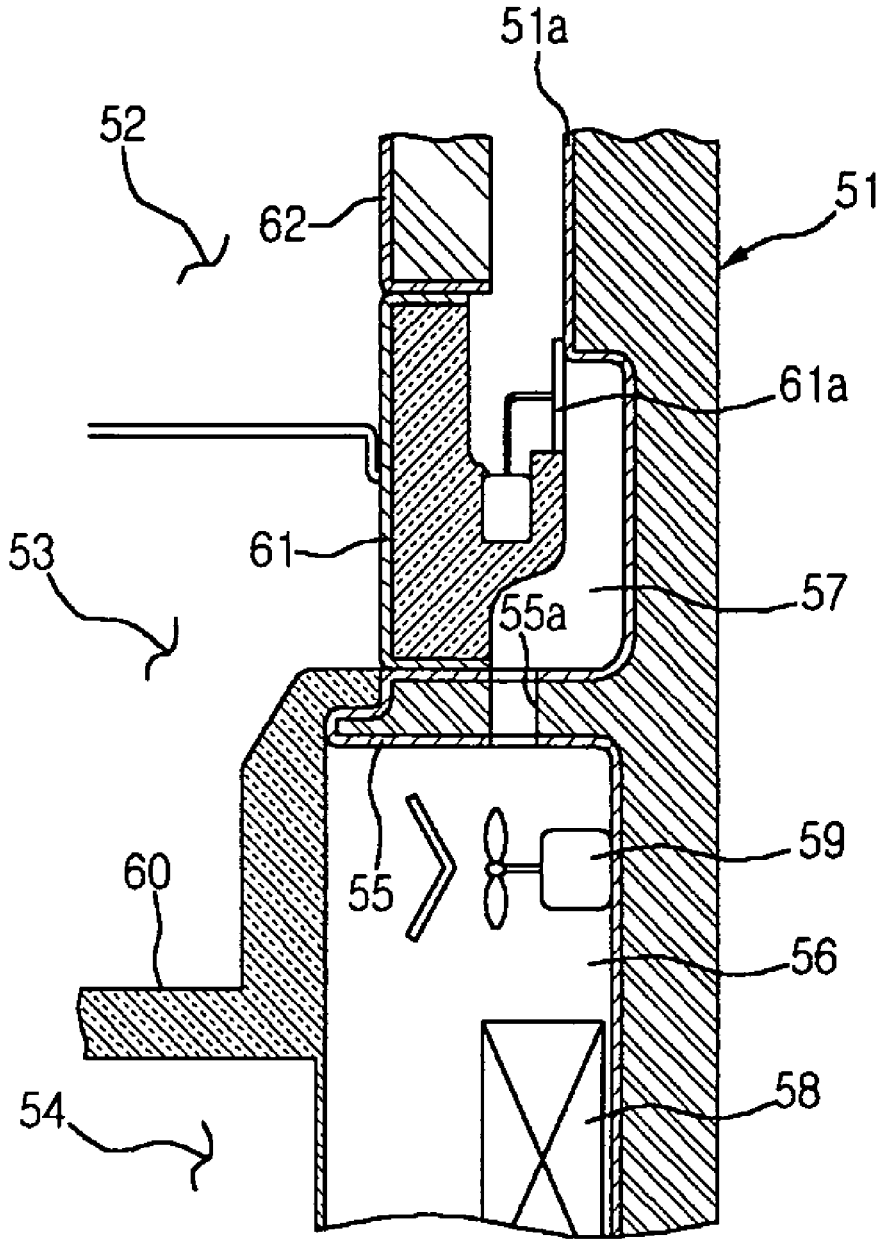
FIG. 1 is a side sectional view showing main components of a general refrigerator.
Figure 2:
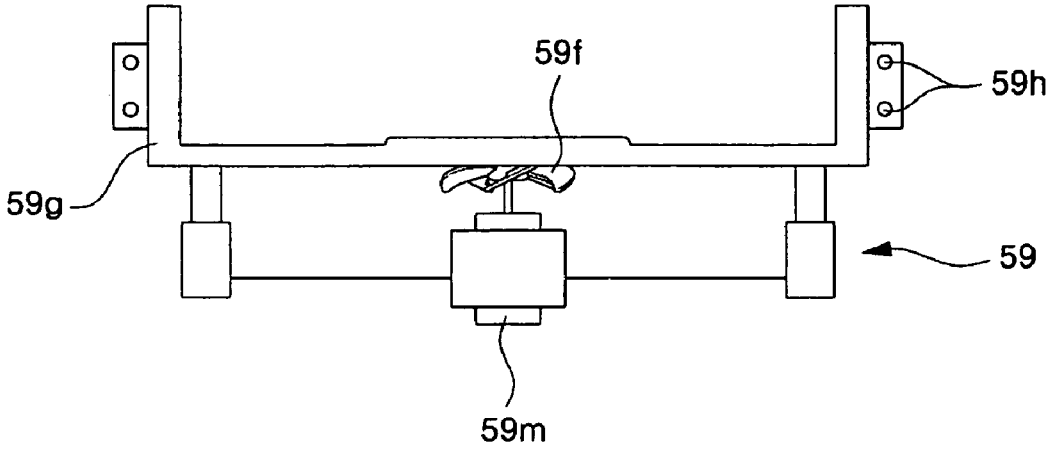
FIG. 2 is a side sectional view of a related art heat exchange chamber.
Figure 3:
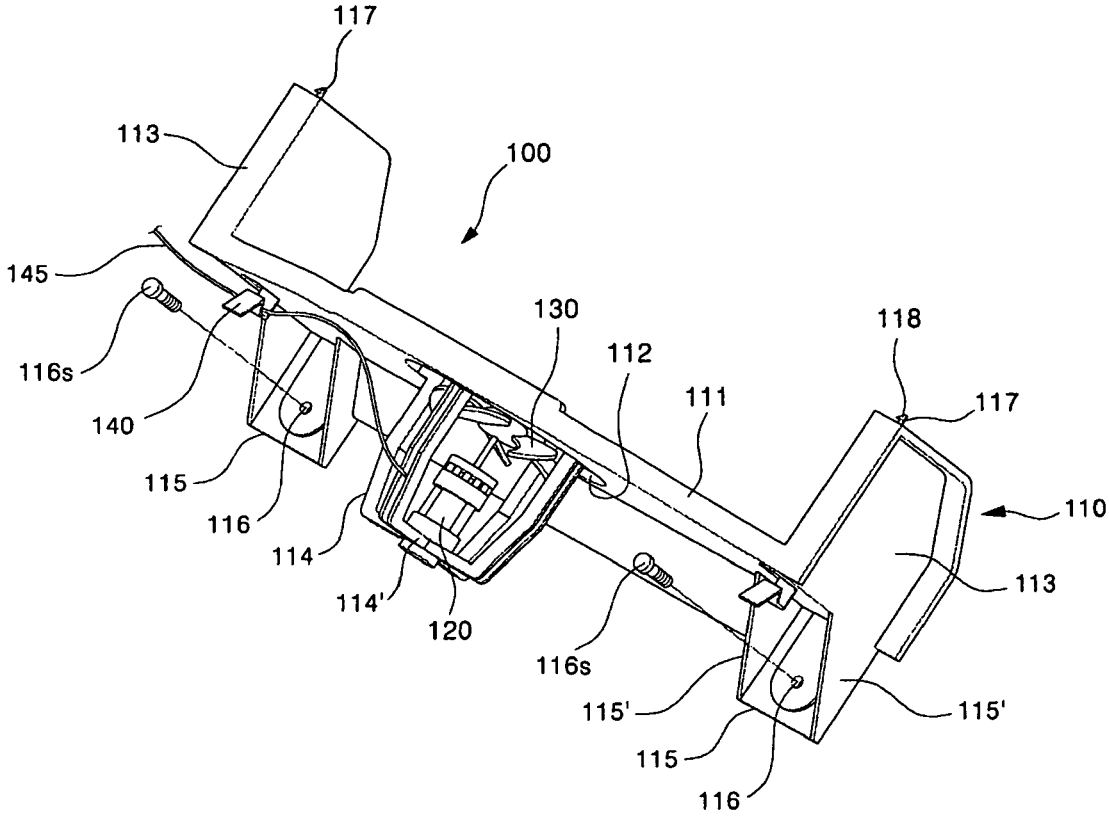
FIG. 3 is a perspective view showing a fan assembly for a refrigerator according to a preferred embodiment of the present invention.
Figure 4A:
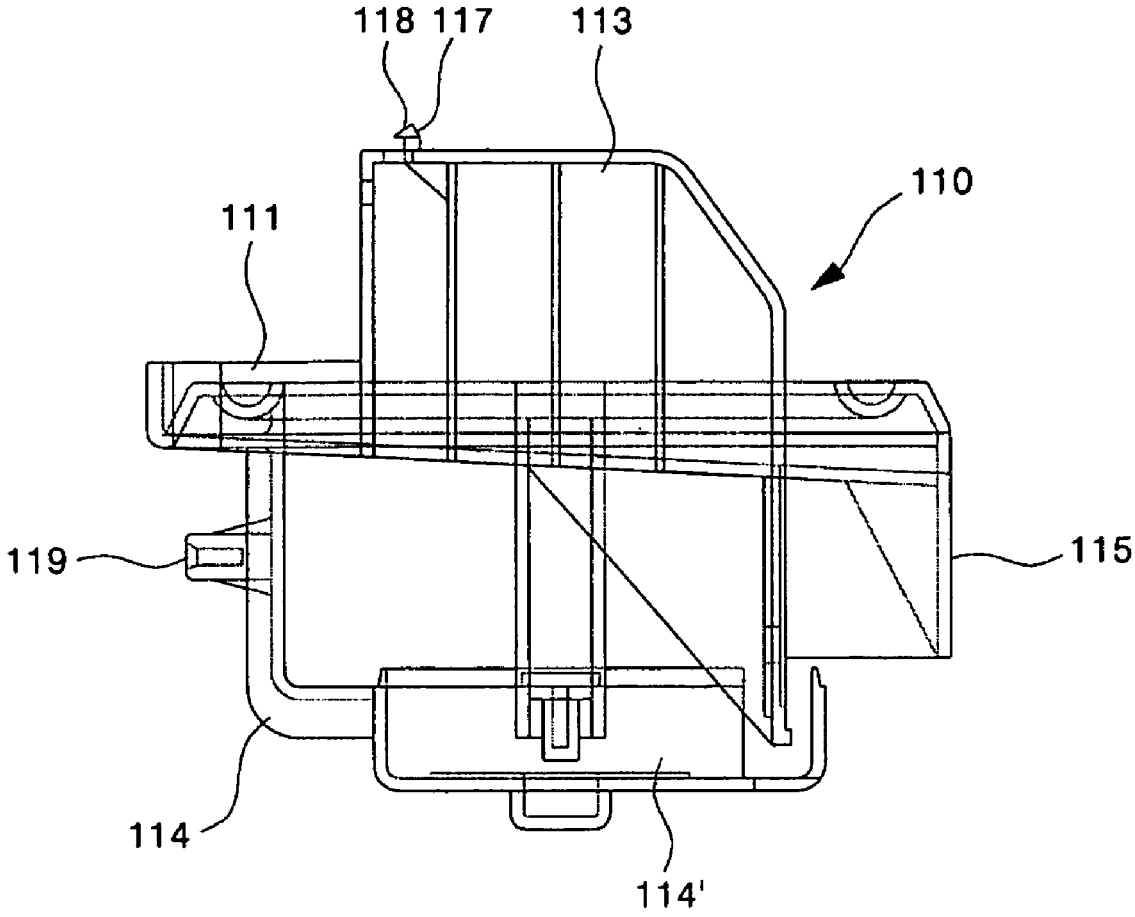
FIG. 4*a* is a side view showing the configuration of the fan assembly according to the preferred embodiment of the present invention.
Figure 4B:
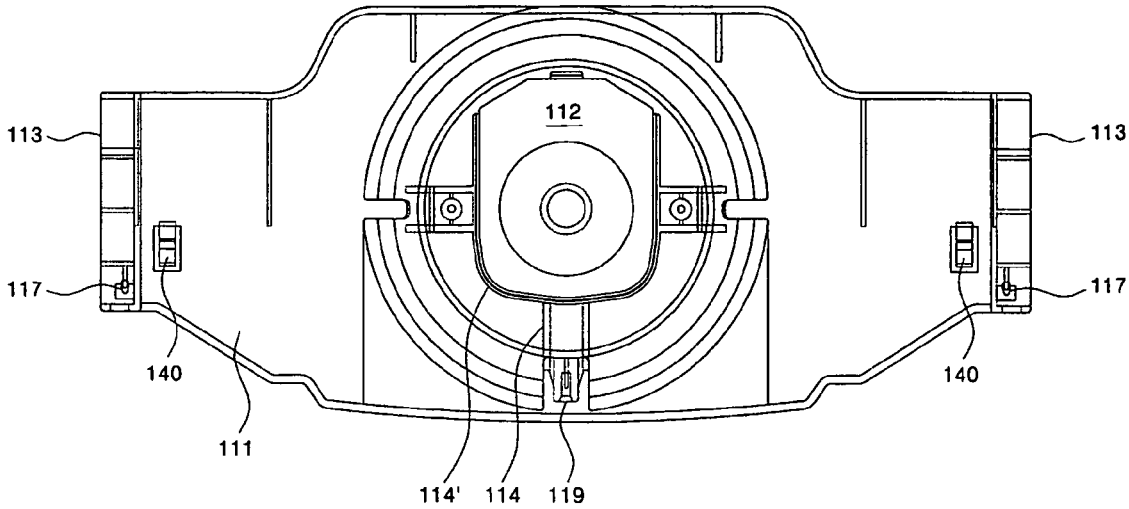
FIG. 4*b* is a plan view showing the configuration of the fan assembly according to the preferred embodiment of the present invention.
Figure 5:
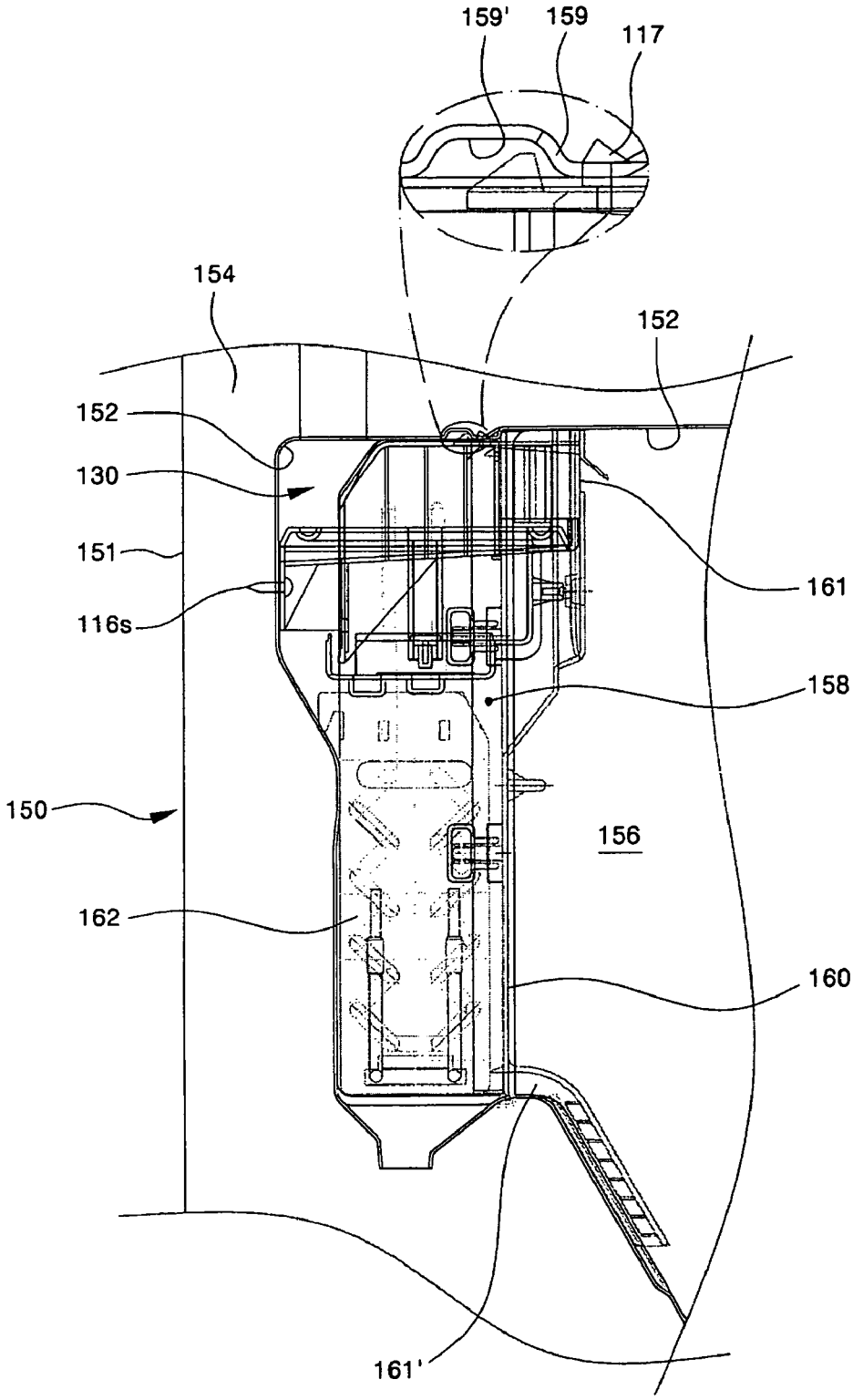
FIG. 5 is a sectional view showing a state where the fan assembly of the present invention is installed in a heat exchange chamber.
Figure 6:
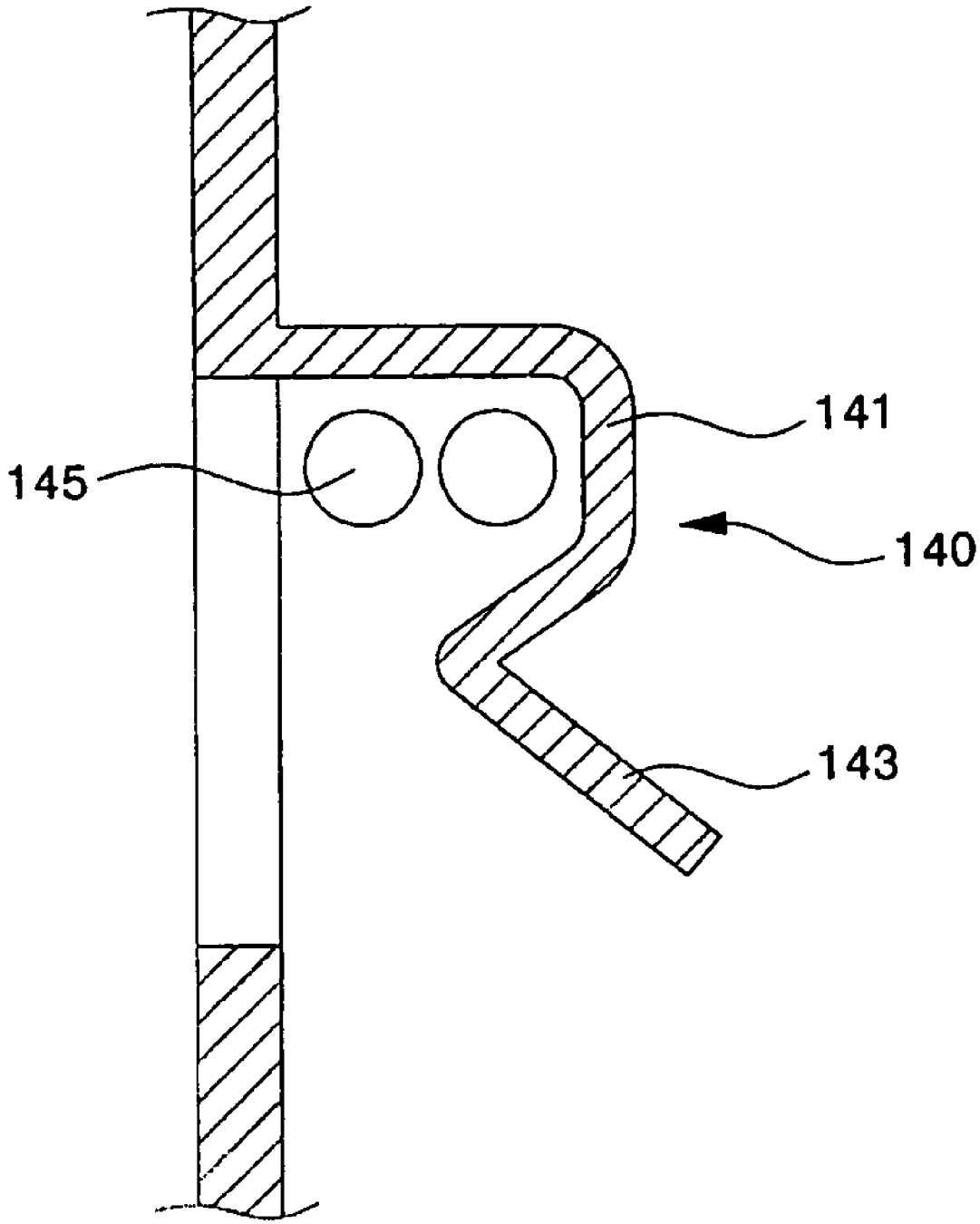
FIG. 6 is a sectional view of a wire hanger of the fan assembly according to the preferred embodiment of the present invention.

FIG. 3 is a perspective view showing the fan assembly for the refrigerator according to the preferred embodiment of the present invention; FIGS. 4*a* and 4*b* are side and plan views showing the configuration of the fan assembly according to the preferred embodiment of the present invention, respectively; and FIG. 5 is a sectional view showing a state where the fan assembly of the present invention is installed in a heat exchange chamber.

Referring to these figures, a fan assembly 100 generally comprises a fan guide 110, a fan motor 120 and a blow fan 130. The fan assembly 100 is installed in a heat exchange chamber 158 and serves to transfer cold air into a storage space of the refrigerator. In particular, the fan assembly 100 of the present invention causes the cold air to be transferred in a direction opposite to a gravitation direction.

The fan guide 110 serves to support the fan motor 120 and the blow fan 130 within the heat exchange chamber 158 and to vertically partition the heat exchange chamber 158. The fan guide 110 includes a horizontal base 111 installed horizontally within the heat exchange chamber 158. The horizontal base 111 is generally formed to take the shape of a plate and is provided with a through-hole 112 at the center thereof. The through-hole 112 becomes a passage through which the blow fan 130 causes cold air to pass.

Vertical walls 113 are formed at opposite ends of the horizontal base 111. The vertical walls 113 protrude from the horizontal base 111 by a predetermined height. A plurality of link legs 114 are formed around portions of the horizontal base 111 adjoining the through-hole 112 to protrude in a direction opposite to the protruding direction of the vertical walls 113. A motor support 114' is provided such that it can be connected to respective tip ends of the plurality of link legs 114. The motor support 114' is provided at a position corresponding to the center of the through-hole 112.

The horizontal base 111 is also provided with mounting legs 115 which protrude from the horizontal base in a direction opposite to the protruding direction of the vertical walls 113. The mounting legs 115 are used to mount the fan guide 110 onto a rear wall of the heat exchange chamber 158. At least two mounting legs are formed at one side of the horizontal base 111. The mounting legs 115 are formed to extend from a bottom surface of the horizontal base 111. Each of the mounting legs 115 includes a pair of shield walls 115' vertically extending from both lateral ends. The shield walls 115' serve to secure a space sufficient to manipulate a tool for tightening a fastening screw 116*s*.

Each of the mounting legs 115 is provided with a mounting hole 116 penetrated therethrough. The fastening screw 116*s* that is fastened to an inner case 152 defining the rear wall of the heat exchange chamber 158 passes through the mounting hole 116.

Furthermore, a fixing hook 117 is formed on an upper end of the vertical wall 113 and provided with a hook jaw 118 protruding perpendicular at a tip end of the fixing hook 117. The hook jaw 118 extends in substantially parallel with the horizontal base 111 in a direction opposite to a direction in which the mounting hole 116 is formed. The hook jaw 118 of the fixing hook 117 is hooked into a hook hole to be explained later is hooked.

A fastening rib 119 is formed on a side of one of the link legs 114. The fastening rib 119 is coupled to a grille pan 160 to be explained later. The fastening rib 119 is formed on the link leg 114 that can be viewed from the extension direction of the hook jaw 118 of the fixing hook 117.

The fan motor 120 is mounted to the motor support 114', and the blow fan 130 is provided on a rotating shaft of the fan motor 120. The blow fan 130 is provided on a position corresponding to the through-hole 112. The blow fan 130 is driven by the fan motor 120 to transfer cold air to a storage space of the refrigerator.

A wire hanger 140 is formed on a surface of the horizontal base 111 from which the mounting legs 115 protrude. A lead wire 145 for applying driving electrical signals to the fan motor 120 is hung and held on a wire hanger 140. The wire hanger 140 is formed on both ends of the horizontal base 111 in the preferred embodiment of the present invention, but it is not necessary to be limited thereto. The wire hanger may be formed on only one end of the horizontal base 111.

The wire hanger 140 is integrally formed with the horizontal base 111 and includes a hanger portion 141 for receiving and substantially hanging a portion of the lead wire 145 and a guide portion 143 for guiding the lead wire 145 into the hanger portion 141. The guide portion 143 of the wire hanger is inclined at a predetermined angle and extends in a direction facing away from the horizontal base 111 as it goes toward the tip. This is because the lead wire 145 can be easily inserted in the hanger portion 141 of the wire hanger 140. For reference, one end of the lead wire 145 is connected to a control unit of the refrigerator, an intermediate portion thereof is buried in an insulating layer 154, and the other end thereof passes through the inner case 152 and extends into the heat exchange chamber 158.

In the meantime, how to install the fan assembly 130 into a main body 150 of the refrigerator will be hereinafter described. An outer case 151 defines an external surface of the main body 150 of the refrigerator and the inner case 152 defines an interior surface of the main body. The insulating laye4 154 is formed between the outer and inner cases. A storage space, i.e. a freezing chamber, is formed within the main body 150 of the refrigerator. The freezing chamber 156 is located at a relatively lower portion of the main body 150 of the refrigerator. A refrigerating chamber is located at a relatively upper portion of the main body 150 of the refrigerator in which a vegetable box separate from the refrigerating chamber may be provided according to given design requirements.

The heat exchange chamber 158 is formed at a rear portion of the freezing chamber 156 by partitioning the freezing chamber by the grille pan 160. Fastening holes into which the mounting legs 115 are mounted are formed in the inner case 152 that defines the rear wall of the heat exchange chamber 158 (a portion corresponding to a rear surface of the heat exchange chamber 158 when viewed in front of the freezing chamber 156). As well shown in FIG. 5, the hook hole 159 is formed in the inner case 152 corresponding to a ceiling of the heat exchange chamber 158. The hook hole 159 is formed in a recess 159' that is formed by depressing the inner case 152 into the insulating layer 154.

An outlet port 161, through which the heat exchange chamber 158 and the freezing chamber 156 communicate with each other so as to allow the cold air produced in the heat exchange chamber 158 to be transferred to the freezing chamber 156, is formed in a relatively upper portion of the grille pan 160. An inlet port 161' is formed at a lower portion of the grille pan 160. The cold air circulating in the freezing chamber 156 is returned to heat exchange chamber 158 through the inlet port 161'.

An evaporator 162 is installed within the heat exchange chamber 158 in which cold air is produced by means of heat exchange between air and working fluid during the heat exchange cycle.

Hereinafter, an operation of the fan assembly for the refrigerator according to the present invention so configured will be described in detail.

First, how to install the fan assembly 100 of the present invention within the heat exchange chamber 158 is now described. Of course, the fan assembly 100 is in a state where the fan motor 120 and the blow fan 130 have been already mounted to the fan guide 110.

In a state where the grille pan 160 is removed, the fan assembly 100 is placed at a relatively upper portion of the heat exchange chamber 158. At this time, the hook jaw 118 of the fixing hook 117 of the fan guide 159 is caused to be hooked into the hook hole such that the fan assembly 100 can be temporarily fixed.

In such a state, the fastening screw 116*s* passes through the mounting hole 116 of the mounting leg 115 and is tightened into the fastening hole formed in the inner case 152. At this time, a desired tool can be positioned between the shield walls 115' of the mounting leg 115 and used to tighten the fastening screw 1116*s*.

Next, one side of the lead wire 145 protruding into the heat exchange chamber 158 is hung on the wire hanger 140. That is, the lead wire 145 is inserted between the guide portion 143 and the horizontal base 111 such that it can be hung on the hanger portion 141 of the wire hanger 140. Of course, the lead wire 145 may be hung on the wire hanger 140 even in a state where the fan assembly 100 is temporarily fixed. If the lead wire 145 is hung on the wire hanger 140, the lead wire 145 neither sags nor is prevented from being damaged due to the contact with the evaporator 162.

After all components have been completely installed within the heat exchange chamber 158, the grille pan 160 is installed. The heat exchange chamber 158 is divided from the freezing chamber 156 by installing the grille pan 160 within the freezing chamber 156. A fastening screw is then fastened into the fastening rib 119 through the grille pan 160.

Hereinafter, it is explained how the cold air is supplied into the refrigerating chamber and the freezing chamber 156 by means of the fan assembly 100 according to the preferred embodiment of the present invention. If the heat exchange cycle of the refrigerator is started, a working fluid is supplied to the evaporator 162, heat exchange between the working fluid and air occurs, and cold air is produced.

The cold air flows by means of the operation of the fan assembly 100. That is, as the blow fan 130 rotates, the cold air produced in the evaporator 162 is sucked or drawn up. The cold air that has passed through the blow fan 130 is transferred to a desired position such as the refrigerating chamber via the outlet port 161 of the grille pan 160 or a cold air passage formed through the ceiling of the heat exchange chamber 158.

Furthermore, the cold air circulating in the freezing chamber 156 flows into the heat exchange chamber 158 through the inlet port 161' and is heat exchanged with the working fluid in the evaporator while passing through the evaporator 162 upward from below. Of course, cold air circulating in the refrigerating chamber is also transferred to the heat exchange chamber 158 through a return passage (not shown) leading to a lower portion of the heat exchange chamber via the interior of the main body 150 of the refrigerator and is then heat exchanged in the heat exchange chamber 158. The cold air that is heat exchanged in the heat exchange chamber 158 circulates again in the interior of the refrigerator by means of the fan assembly 100.

As specifically described above, a fan assembly for a refrigerator according to the present invention has the following advantageous effects.

First, since the fan assembly of the present invention can be temporarily fixed upon its installation, even a single operator can easily couple or decouple the fan assembly into or from the heat exchange chamber. Further, since a working space required for a tool used to tighten or loosen the screws for the mounting legs can be sufficiently secured, there is an advantage in that workability is enhanced.

In addition, since the fan assembly of the present invention is supported in such a manner that the mounting legs are mounted onto the rear surface of the heat exchange chamber and the fixing hooks are also hooked into the ceiling of the heat exchange chamber, the fan assembly can be more firmly installed within the heat exchange chamber such that the horizontal base is correctly leveled. In particular, since the fastening rib of the link leg is coupled to the grille pan at a side opposite to where the mounting legs are provided, there is another advantage in that the horizontal base can be kept to be more correctly horizontal.

Accordingly, the fan assembly can produce more correct air streams. Thus, there are additional advantages in that cold air can be more correctly transferred to the refrigerating and freezing chambers and its leakage cannot occur.

Furthermore, since the wire hanger for holding the lead wire is formed on the fan guide, the lead wire can be fixed in a state where it does not sag. Therefore, the lead wire can be prevented from being damaged due its contact with the evaporator in the heat exchange chamber and the withstanding voltage of the lead wire can be prevented from being lowered due to a low temperature from the evaporator.

Although the present invention has been described in connection with the preferred embodiments. It will be apparent to those skilled in the art that various changes and modifications can be made thereto without departing from the scope and spirit of the present invention. Therefore, the embodiments should be considered as not restrictive but illustrative. Further, the true scope of the present invention is defined by the appended claims, and changes and modifications should be constructed as falling within the scope of the present invention.

What is claimed is:

1. A fan assembly for a refrigerator, comprising:

a fan motor;

a blow fan driven by the fan motor for producing a cold air flow in a direction opposite to a gravitational direction;

a fan guide for horizontally partitioning a heat exchange chamber, the fan motor and the blow fan being installed on the fan guide, the cold air flow passing through the fan guide;

a mounting leg formed on one side of the fan guide and coupled to a rear wall of the heat exchange chamber with a fastening screw; and a fixing hook formed on the fan guide at a side opposite to the mounting leg and hooked into a ceiling of the heat exchange chamber.

2. The fan assembly as claimed in claim 1, wherein the fan guide includes:

a horizontal base having a through-hole formed therein, the air flow passing through the through-hole; and a pair of vertical walls protruding, respectively, from both ends of the horizontal base, the fixing hook being provided on an upper end of the vertical wall.

3. The fan assembly as claimed in claim 2, wherein a plurality of link legs are formed around portions of the horizontal base adjoining the through-hole, and a motor support with the motor seated thereon is provided on tip ends of the link legs.

4. The fan assembly as claimed in claim 3, wherein one of the link legs positioned at a side opposite to a mounting direction of the mounting leg is further provided with a fastening rib coupled to a grille pan for partitioning the heat exchange chamber.

5. The fan assembly as claimed in claim 1, wherein the mounting leg is provided with shield walls extending in a longitudinal direction at both ends thereof.

6. The fan assembly as claimed in claim 1, wherein the fan guide is integrally formed with at least one wire hanger onto which a lead wire is hung.

7. The fan assembly as claimed in claim 6, wherein the wire hanger includes:

a hanger portion with one end thereof connected to the fan guide, the lead wire being securely positioned into the hanger portion; and a guide portion for guiding the lead wire into the hanger portion, the guide portion being further spaced apart from a surface of the fan guide as it goes toward the tip.

8. A fan assembly for a refrigerator including a refrigerating chamber formed at a relatively lower portion of a main body of the refrigerator, a freezing chamber formed at a relatively upper portion of the main body and a heat exchange chamber partitioned behind at least the freezing chamber for producing cold air, comprising:

a fan motor;

a blow fan driven by the fan motor for producing a cold air flow supplied to the refrigerating and freezing chambers;

a fan guide with the cold air flow passing therethrough, the fan motor and the blow fan being installed on the fan guide;

at least two mounting leg formed on one side of the fan guide and coupled to a rear wall of the heat exchange chamber with fastening screws;

a fixing hook formed on the fan guide at a side opposite to the mounting leg and hooked into a ceiling of the heat exchange chamber; and at least one wire hanger provided on the fan guide, wherein a lead wire through which electrical signals for driving the fan motor are transferred is hung and supported on the wire hanger.

9. A fan assembly as claimed in claim 8, wherein the fan guide includes:

a horizontal base having a through-hole formed therein, the mounting legs and the wire hanger being formed on the horizontal base; and a pair of vertical walls protruding, respectively, from both ends of the horizontal base in a direction opposite to the mounting legs, the fixing hook being provided on an upper end of the vertical wall.

10. The fan assembly as claimed in claim 9, wherein a plurality of link legs are formed around portions of the horizontal base adjoining the through-hole, and a motor support on which the motor is seated is provided on tip ends of the link legs.

11. The fan assembly as claimed in claim 10, wherein one of the link legs positioned at a side opposite to a mounting direction of the mounting leg is further provided with a fastening rib coupled to a grille pan for partitioning the heat exchange chamber.

12. The fan assembly as claimed in claim 8, wherein the wire hanger includes:

a hanger portion, one end of the hanger portion being connected to the fan guide, the lead wire being securely positioned into the hanger portion; and a guide portion for guiding the lead wire into the hanger portion, the guide portion being further spaced apart from a surface of the fan guide as it goes toward the tip.

13. A fan assembly for a refrigerator, comprising:

a fan motor;

a blow fan driven by the fan motor for producing a cold air flow which is supplied to refrigerating and freezing chambers formed in a main body of the refrigerator;

a fan guide with the cold air flow passing therethrough, the fan motor and the blow fan being installed on the fan guide; and at least one wire hanger provided on the fan guide, wherein a lead wire through which electrical signals for driving the fan motor are transferred is hung and supported on the wire hanger.

14. The fan assembly as claimed in claim 13, wherein the fan guide includes:

a horizontal base horizontally formed in a heat exchange chamber, the air flow passing through the horizontal base, the horizontal base being formed with at least two mounting legs coupled to the heat exchange chamber at one side thereof; and a pair of vertical walls protruding from both ends of the horizontal base in a direction opposite to the mounting legs, wherein a fixing hook hung into a ceiling of the heat exchange chamber is formed on a tip end of the vertical wall at a side of the horizontal base opposite to where the mounting legs are provided.

15. The fan assembly as claimed in claim 14, wherein a through-hole with the cold air flow passing therethrough is formed in the horizontal base, a plurality of link legs are formed around portions of the horizontal base adjoining the through-hole, and a motor support on which the motor is seated is provided on tip ends of the link legs.

16. The fan assembly as claimed in claim 15, wherein one of the link legs positioned at a side opposite to a mounting direction of the mounting leg is further provided with a fastening rib coupled to a grille pan for partitioning the heat exchange chamber.

17. The fan assembly as claimed in claim 13, wherein the wire hanger includes:

a hanger portion, one end of the hanger portion being connected to the fan guide, the lead wire being securely positioned into the hanger portion; and a guide portion for guiding the lead wire into the hanger portion, the guide portion being further spaced apart from a surface of the fan guide as it goes toward the tip.

* * * * *